US006629867B1

(12) United States Patent
Smith

(10) Patent No.: US 6,629,867 B1
(45) Date of Patent: Oct. 7, 2003

(54) SPOOLED RAPIDLY DEPLOYABLE LIFE LINE

(76) Inventor: James Smith, 2009 Mark Ave., Punta Gorda, FL (US) 33950

( * ) Notice: Subject to any disclaimer, the term of this patent is extended or adjusted under 35 U.S.C. 154(b) by 0 days.

(21) Appl. No.: 10/241,850

(22) Filed: Sep. 13, 2002

Related U.S. Application Data

(63) Continuation-in-part of application No. 09/838,038, filed on Apr. 20, 2001, now abandoned.
(60) Provisional application No. 60/254,408, filed on Dec. 12, 2000.

(51) Int. Cl.[7] ..... B63C 9/08
(52) U.S. Cl. ..... 441/81; 441/84
(58) Field of Search ..... 441/80, 81, 82, 441/83, 84, 88

(56) References Cited

U.S. PATENT DOCUMENTS 5,562,512 A * 10/1996 Samelian ..... 441/81
5,820,109 A * 10/1998 Jermyn et al. ..... 254/362
5,895,299 A * 4/1999 Hyde ..... 441/84
6,019,651 A * 2/2000 Driscoll et al. ..... 441/84

FOREIGN PATENT DOCUMENTS

CA 001225545 * 8/1987 ..... 441/84

* cited by examiner

*Primary Examiner*—Stephen Avila
(74) *Attorney, Agent, or Firm*—Frank A. Lukasik

(57) ABSTRACT

A rapidly deployable personal flotation device for water-borne vessels consisting of a top half having a raised center portion and a bottom half having a raised center portion, the two halfs being joined together at the center by a spacer to form a spool for winding a line around the spacer for storage. A "U" shaped handle is tied to the outside end of the rope for gripping the line while throwing and for holding the line in place when not in use. The device is made from USCG approved plastic materials.

2 Claims, 4 Drawing Sheets

SPOOLED RAPIDLY DEPLOYABLE LIFE LINE

RELATED INVENTION

This application is a continuation of Provisional Application Ser. No. 60/254,408 Filed Dec. 8, 2000 and a Continuation-In-Part of Ser. No. 09/838,038, Filed Apr. 20, 2001 now abandoned.

BACKGROUND OF THE INVENTION

1. Field of the Invention

This invention relates generally to safety equipment for waterborne vessels and more particularly to a rapidly deployable Personal Flotation Device (PFD) in the form of a disc upon which a safety line is spooled and which is thrown to a person in distress.

2. Prior Art

Boat operators are expected to make sure that their boats carry at least a minimum of safety equipment. The Coast Guard sets minimum safety standards for vessels and associated equipment. To meet these standards, some of the equipment must be Coast Guard Approved. "Coast Guard Approved Equipment" has been determined to be in compliance with U.S. Coast Guard (USCG) specifications and regulations relating to performance, construction, or materials.

Personal Flotation Devices (PFDs) must be USCG approved, in good and serviceable condition and of appropriate size for the intended user. The wearable PFDs must be readily accessible, meaning that you must be able to put them on in a reasonable amount of time in an emergency.

One of the types of PFDs is a TYPE IV PFD. A TYPE IV PFD is a throwable device intended for calm, inland water with heavy boat traffic, where help is always present. It is designed to be thrown to a person in the water and grasped and held by the user until rescued. It is not designed to be worn. TYPE IV devices include buoyant cushions, ring buoys, and horseshoe buoys.

In addition to the rules for TYPE IV PFDs, a forty foot line is required to be attached to the PFD. Currently, the lines are attached and stored with the flotation device.

Existing throwable life rings are generally deployed from the deck of a vessel or dock and take the form of a floatable ring tethered to a line. These rings are thrown to the distressed swimmer and the line is thereafter used to retrieve the ring and the swimmer. In an emergency, speed is essential and the line must be accessible and not tangled. Because there is no control over the location or condition of the line, it may become tangled and fail to reach the person in the water when thrown.

The present invention seeks to address the inherent weaknesses in conventional life rings by providing an accessible and swiftly deployable flotation device to a distressed swimmer.

SUMMARY OF THE INVENTION

It is therefore an object of the invention to provide a floatable life preserver formed as a pair of discs which permit a life line to be spooled upon an inner hub such that the line is deployed smoothly as the device is thrown.

It is a further object of the invention to provide foam plastic outer chambers containing air which permit the device to float. Such chambers having the advantage of light weight and resistance to saturation with prolonged immersion in water.

It is a further object of the invention to provide a flotation device which can be deployed by persons who are either right or left handed.

It is a further object of the invention to provide a flotation device which is simple and inexpensive to manufacture. The device as described herein consists of a pair of identical, disc-shaped forms joined at a common central hub.

DESCRIPTION OF A PREFERRED EMBODIMENT

Figure 1:
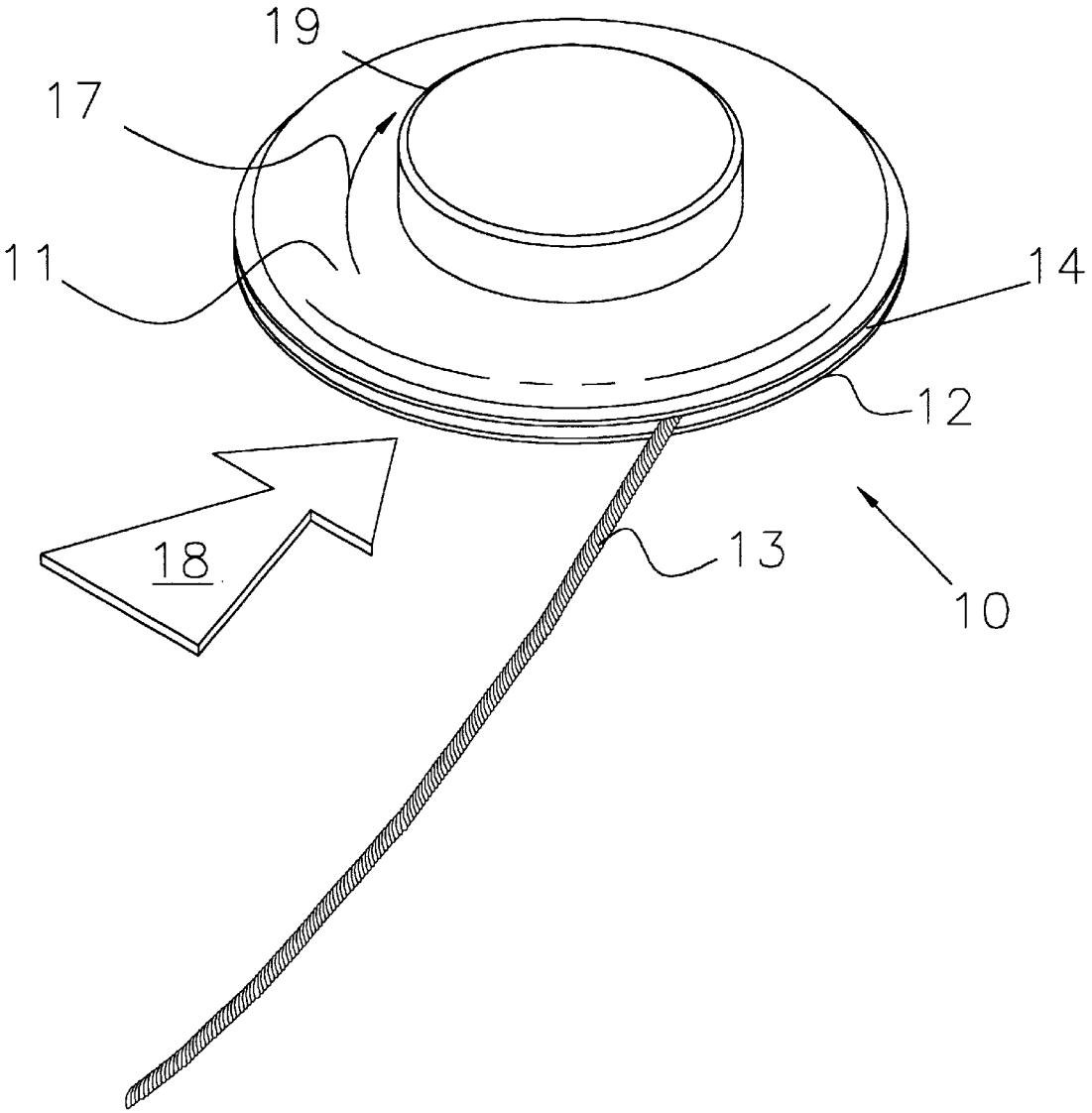
FIG. 1 is a perspective view of the present invention as it would appear during deployment.

Referring now to the drawings, wherein like numerals designate like and corresponding parts throughout the several views, in FIG. 1 the invention is designated overall by the numeral 10. The instant invention is generally round in shape and consists of two principal parts, the top half 11 and the bottom half 12. Each of the sections are constructed of USCG Approved materials. The top half 11 and the bottom half 12 are joined together at the center by a spacer 15 (FIG. 2) to form a spool for winding the line 13 (rope) around the spacer 15 for storage. The space 14 is sufficiently wide to hold the full forty feet of wrapped line 13 and includes a flat surface free of any protrusions and extends to central hub 15. Top half 11 and bottom half 12 each have flat surfaces and are identical in profile. Raised portions 19 are formed on the outside surface of top half 11 and bottom half 12, near the center line of the spacer 15 to provide a gripping surface for a person in the water and also to provide additional flotation material to meet Coast Guard specification. A flat surface indicated by the numeral "A", extending from the raised portions to the outer edge is provided for sufficient gripping surface for throwing to a person in the water.

A "U" shaped handle 20 is attached to the line 13 through hole 23 and knotted at the end as shown by numeral 21. The handle 20 has a space shown by the letter "B" to provide a gripping force when placed over the edges of top half 11 and bottom half 12 when not in use. Holding the end of the line 13 in a secure grip prevents the line 13 from lying free and subject to entanglement. In operation, the user grips the life line invention 10 in one hand and the handle 20 in the other hand and tosses the device to the person to be rescued. The user then grips the handle 20 and pulls the line 13 and the victim to safety.

The life line 10 of the invention may be thrown in the direction of arrow 18 over the side of the boat in a manner that "Frisbees" are thrown, with the exception that the line 13 is held or attached to the "U" shaped handle 20 to readily pull the person back to the boat. When the person is rescued, the line 13 is easily replaced by winding around the hub 15. The life line 10 may be thrown With the right or left hand by merely turning it over and reversing the hands.

Figure 2:
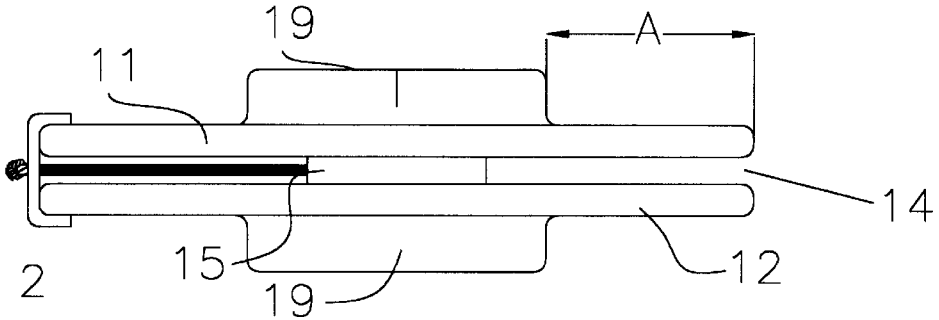
FIG. 2 is an elevational view of the present invention showing each external component.

Referring now to FIG. 2 wherein space 14 is free from any protrusion and extends to central hub 15. Top half 11 and bottom half 12 are identical in profile.

Figure 3:
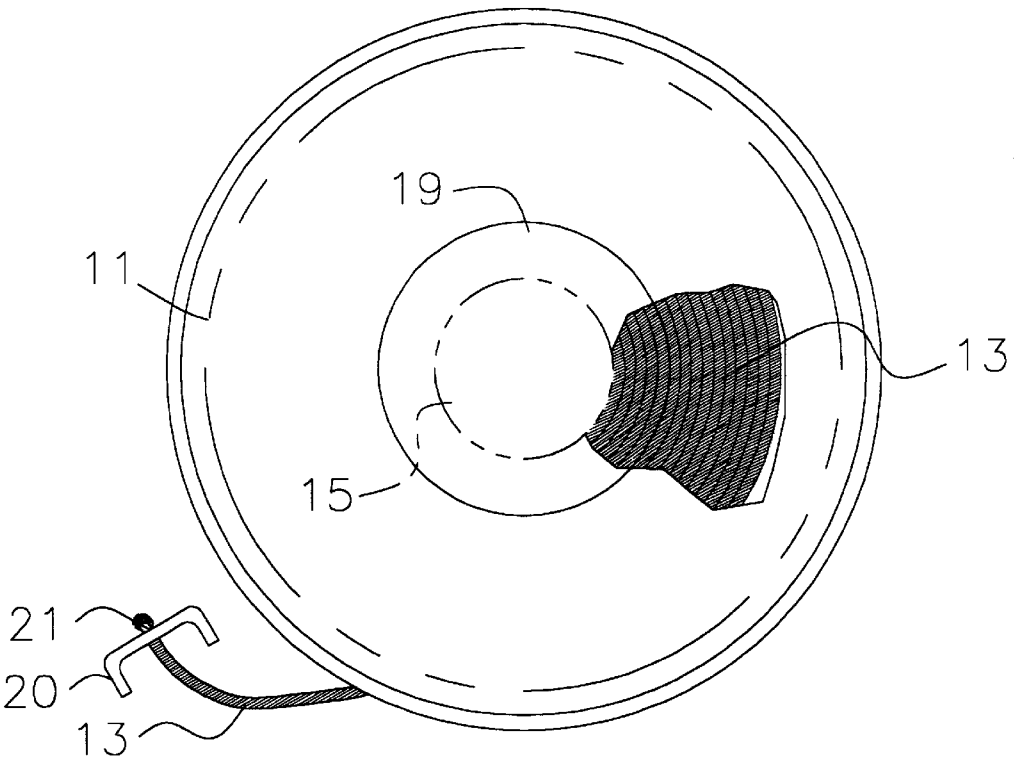
FIG. 3 is a top view of the invention, partially in section, showing the relationship between its disc components and the spooled line which it carries.

Referring now to FIG. 3 shows line 13 spooled around hub 15, extended in part, ready for deployment. Handle 20 is shown detached from the top half 11 and bottom half 12.

Figure 4:
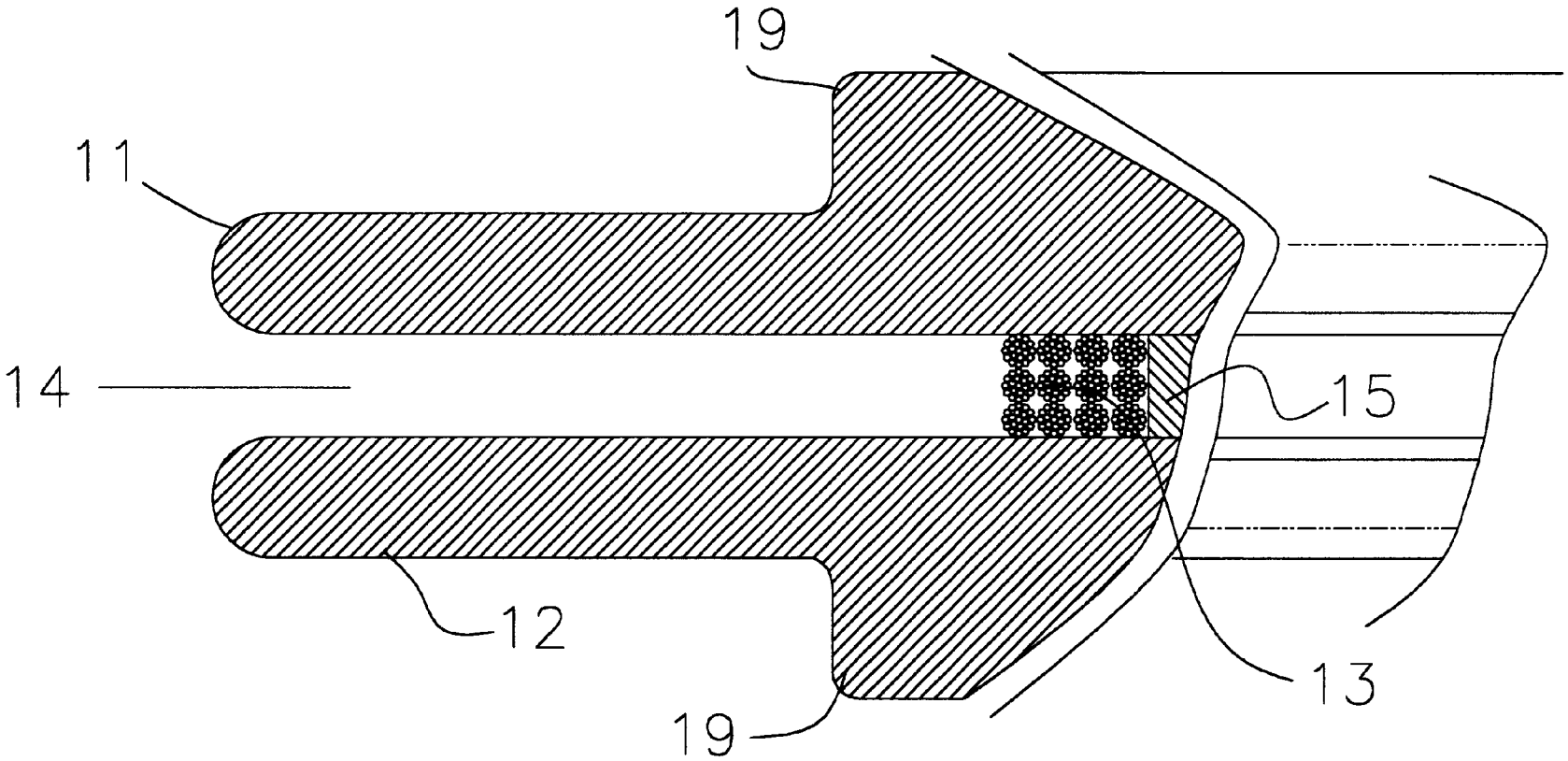
FIG. 4 is an elevational view, partially in section, of the invention showing the internal structure.
Figure 6:
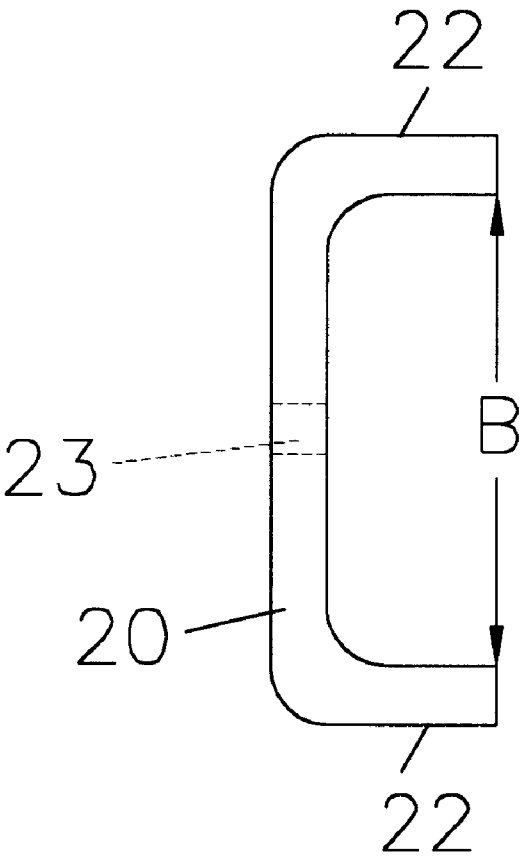
FIG. 6 is an end view of a handle in accordance with the invention.
Figure 5:
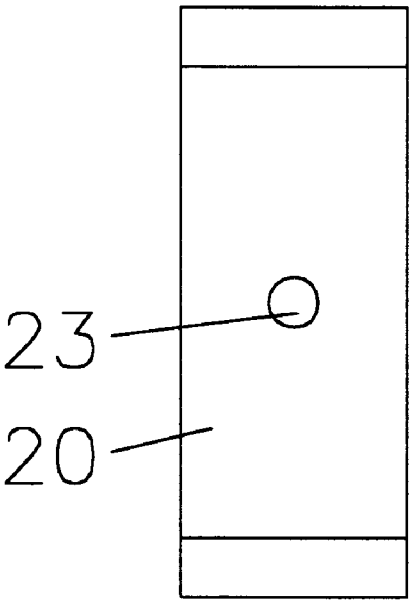
FIG. 5 is a front view of a handle in accordance with the invention.

FIG. 4 shows the general shape of both top 11 and bottom 12 as one form of construction, formed identically of flotation material. Hub 15 joins each half and forms a spool for line 13. Flotation may be foam material components which meet or exceed USCG standards. The particular plastic will be selected based upon the method of manufacturing. Some potential candidates are High Impact Polystyrene (HIP), Polyethylene, Polypropylene, Foam and Polyurethanes. The material selected will be dependent on the manufacturing technique selected. The rope 13 may be assembled as the parts are manufactured or possibly inserted in an additional step.

What is claimed is:

1. A rapidly deployable personal flotation device for waterborne vessels, said flotation device consisting of:

a top half and a bottom half, generally disc shaped forms, and constructed of high impact plastic materials, said top half and said bottom half each having an outer flat surface and an inner flat surface, a raised portion formed on the outside of said top half near the center line of said top half and a raised portion formed on the outside surface of said bottom half near the center line of said bottom half, said top half and said bottom half being joined together at the center to a central hub for winding a line around said central hub for storage, said inner flat surfaces extending inwardly to said central hub, a forty foot safety line having a first end and a second end, said first end being permanently attached to said central hub and wound around said central hub, and a "U" shaped handle being attached at said second end, thereby providing a grip for a user and an attachment to grip said top half and said bottom half for holding said safety line in a ready position.

2. A rapidly deployable personal flotation device for waterborne vessels of claim 1 wherein said flotation device is constructed from a plastic material from the class including, High Impact Polysterene (HIP), Polyethelene, Polypropylene, Foam and Polyurethanes.

* * * * *